US011992723B2

(12) United States Patent
Triplett

(10) Patent No.: US 11,992,723 B2
(45) Date of Patent: May 28, 2024

(54) MULTIFUNCTIONAL EXERCISE APPARATUS

(71) Applicant: Mwalimu Triplett, Toledo, OH (US)

(72) Inventor: Mwalimu Triplett, Toledo, OH (US)

( * ) Notice: Subject to any disclaimer, the term of this patent is extended or adjusted under 35 U.S.C. 154(b) by 122 days.

(21) Appl. No.: 17/406,072

(22) Filed: Aug. 18, 2021

(65) Prior Publication Data

US 2022/0054883 A1 Feb. 24, 2022

Related U.S. Application Data

(60) Provisional application No. 63/067,056, filed on Aug. 18, 2020.

(51) Int. Cl.

| | |
|---|---|
| ***A63B 21/00*** | (2006.01) |
| ***A63B 21/06*** | (2006.01) |
| ***A63B 23/04*** | (2006.01) |
| ***A63B 23/12*** | (2006.01) |

(52) U.S. Cl.

CPC ..... *A63B 21/4035* (2015.10); *A63B 21/0604* (2013.01); *A63B 23/0458* (2013.01); *A63B 23/1236* (2013.01)

(58) Field of Classification Search

CPC ..... A63B 21/0004; A63B 21/00047; A63B 21/0604; A63B 21/068; A63B 21/072; A63B 21/0722; A63B 21/0726; A63B 21/4023; A63B 21/4027; A63B 21/4033; A63B 21/4034; A63B 21/4035; A63B 21/4043; A63B 23/0458; A63B 23/1236; A63B 2208/0204; A63B 2208/0209; A63B 2208/0295; A63B 2209/00

See application file for complete search history.

(56) References Cited

U.S. PATENT DOCUMENTS

| | | | | |
|---|---|---|---|---|
| 4,940,230 | A * | 7/1990 | Jian | A63B 60/02 473/527 |
| 5,222,925 | A * | 6/1993 | Maycock | A63B 23/14 482/44 |
| 5,230,684 | A * | 7/1993 | Wallisch | A63B 23/12 482/141 |
| D339,836 | S * | 9/1993 | Wallisch | D21/692 |
| 5,871,423 | A * | 2/1999 | Pruchnik | A63B 21/22 482/110 |
| 9,616,269 | B1 * | 4/2017 | Burosh | A63B 21/0004 |
| 10,179,259 | B1 * | 1/2019 | Zagata | A63B 23/12 |
| 10,780,317 | B1 * | 9/2020 | Sawhney | A63B 23/03516 |
| D921,777 | S * | 6/2021 | Triplett | D21/686 |
| 11,052,281 | B2 * | 7/2021 | Saldate | A63B 21/0442 |

(Continued)

FOREIGN PATENT DOCUMENTS

| | | | | |
|---|---|---|---|---|
| GB | 2107596 | A * | 5/1983 | A63B 23/14 |

*Primary Examiner* — Gary D Urbiel Goldner

(57) ABSTRACT

A multifunctional exercise apparatus allows a user to perform a variety of exercises by using the multifunctional exercise apparatus as a pushup bar, a step platform, or a kettlebell. The multifunction exercise apparatus includes a base platform, a left handle, and a right handle. The base platform is used as a structure base to arrange and connect the other components together. The left handle allows the user's left hand to grasp the multifunctional exercise apparatus, while the right handle allows the user's right hand to grasp the multifunctional exercise apparatus.

18 Claims, 10 Drawing Sheets

(56) References Cited

U.S. PATENT DOCUMENTS

| | | | | |
|---|---|---|---|---|
| 2005/0101421 | A1* | 5/2005 | Marangoni | A63B 51/015 473/553 |
| 2008/0318743 | A1* | 12/2008 | Bizzell | A63B 21/00047 482/142 |
| 2013/0012367 | A1* | 1/2013 | Williams | A63B 23/03525 482/108 |
| 2014/0057734 | A1* | 2/2014 | Lu | A63B 53/14 473/298 |
| 2018/0169468 | A1* | 6/2018 | Barrie, III | A63B 21/4035 |

* cited by examiner

MULTIFUNCTIONAL EXERCISE APPARATUS

The current application claims a priority to the U.S. Provisional Patent application Ser. No. 63/067,056 filed on Aug. 18, 2020.

FIELD OF THE INVENTION

The present invention generally relates to a piece of exercise equipment. More specifically, the present invention allows a wide variety of exercise regimens and programs to be accomplished. The present invention is designed to effectively assist users in performing push-ups, arm curls, leg workouts, etc. to provide better, faster results.

BACKGROUND OF THE INVENTION

It is well known that exercise is an important aspect of enhancing or maintaining physical fitness and overall health and wellness. A number of studies have shown that exercise provides many positive health benefits that go well beyond improved strength and endurance. For example, exercise can help confront the effects of aging, increase growth and development, reduce stress, anxiety, and depression, enhance memory, stimulate creativity, address psychological disorders, etc. Exercise becomes more popular as the quality of life improves over recent years. The popularity of exercise has become a social activity at health clubs as well as being a benefit in maintaining the medical/physical well-being of an individual.

Typical examples of exercise include running, bicycling, weight-lifting, push-ups, bicep curls, arm raises, leg workouts, etc. Many types of exercise devices have been developed to enhance the strength or conditioning effect of that exercise. For example, push-up bars may be used to perform an improved push-up motion exercise for improved muscle involvement. However, most of these devices lack versatility. In other words, most of the existing devices merely focus on one type of exercise and work on only one body part (e.g., arms, legs, abdominals, etc.). Considering the fact that the exercise devices can be very expensive and require significant space for storage, there is a need in the art to minimize the cost and the number of exercise devices. The present invention aims to solve some of these problems by disclosing a multifunction exercise apparatus which can be used to perform multiple exercises.

SUMMARY OF THE INVENTION

The present invention is a multifunction exercise apparatus designed for performing a variety of exercises. For example, the apparatus of the present invention, known as "better results", can be used as a push-up bar, a kettlebell, and/or a step platform. The apparatus of the present invention is simple in design and easy to use and can be easily manufactured at low cost.

DETAILED DESCRIPTION OF THE INVENTION

Figure 1:
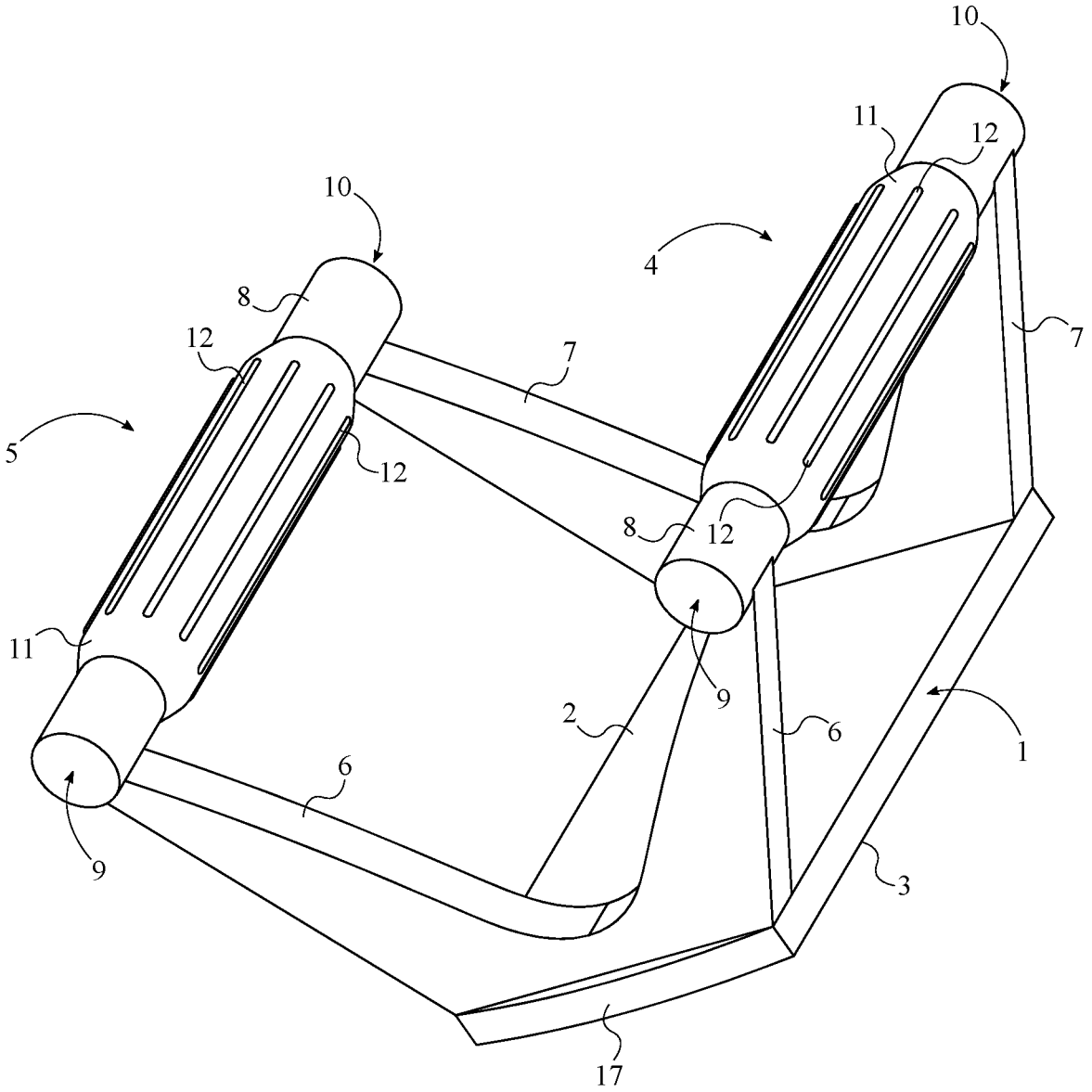
FIG. 1 is a front-left-top perspective view of the present invention.
Figure 2:
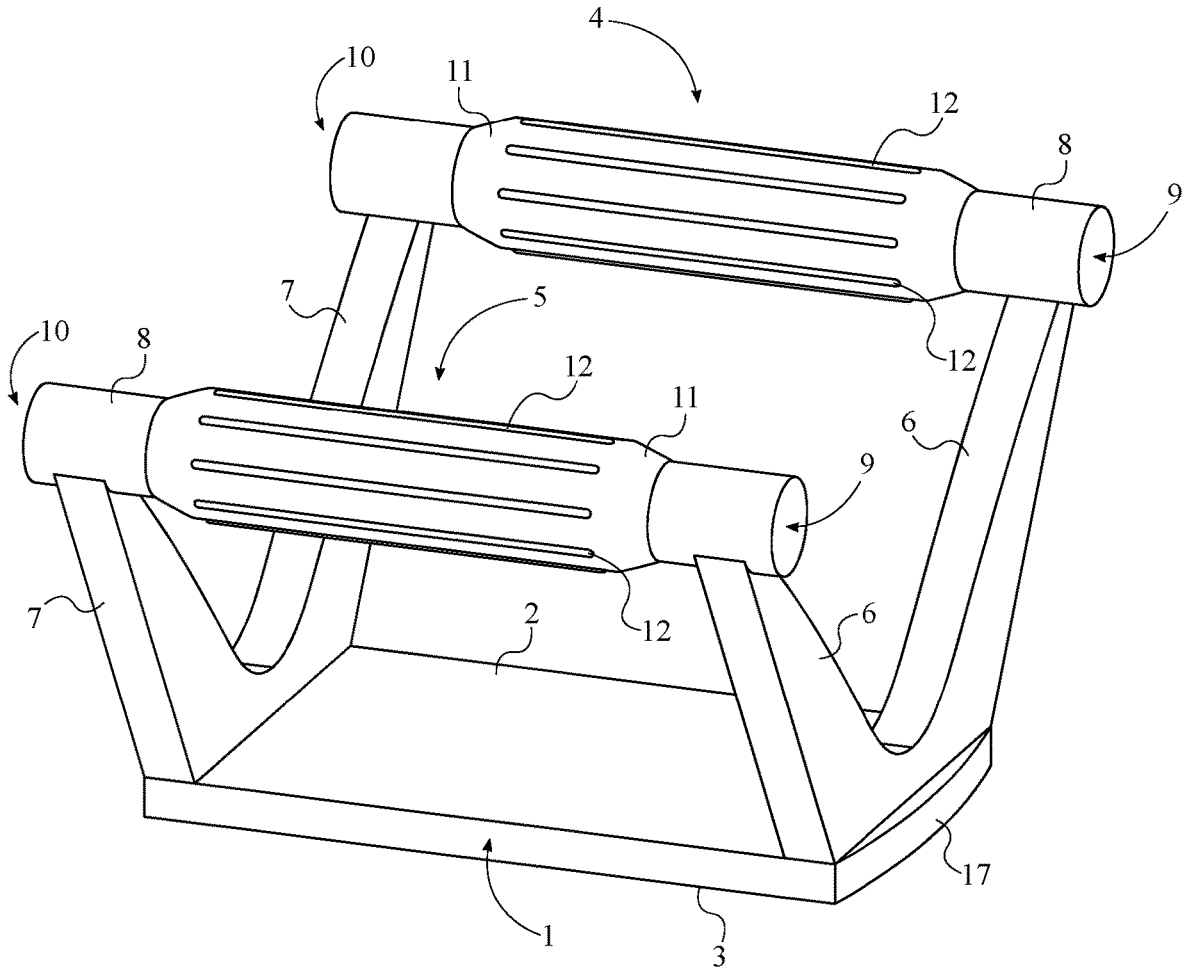
FIG. 2 is a front-right-top perspective view of the present invention.
Figure 3:
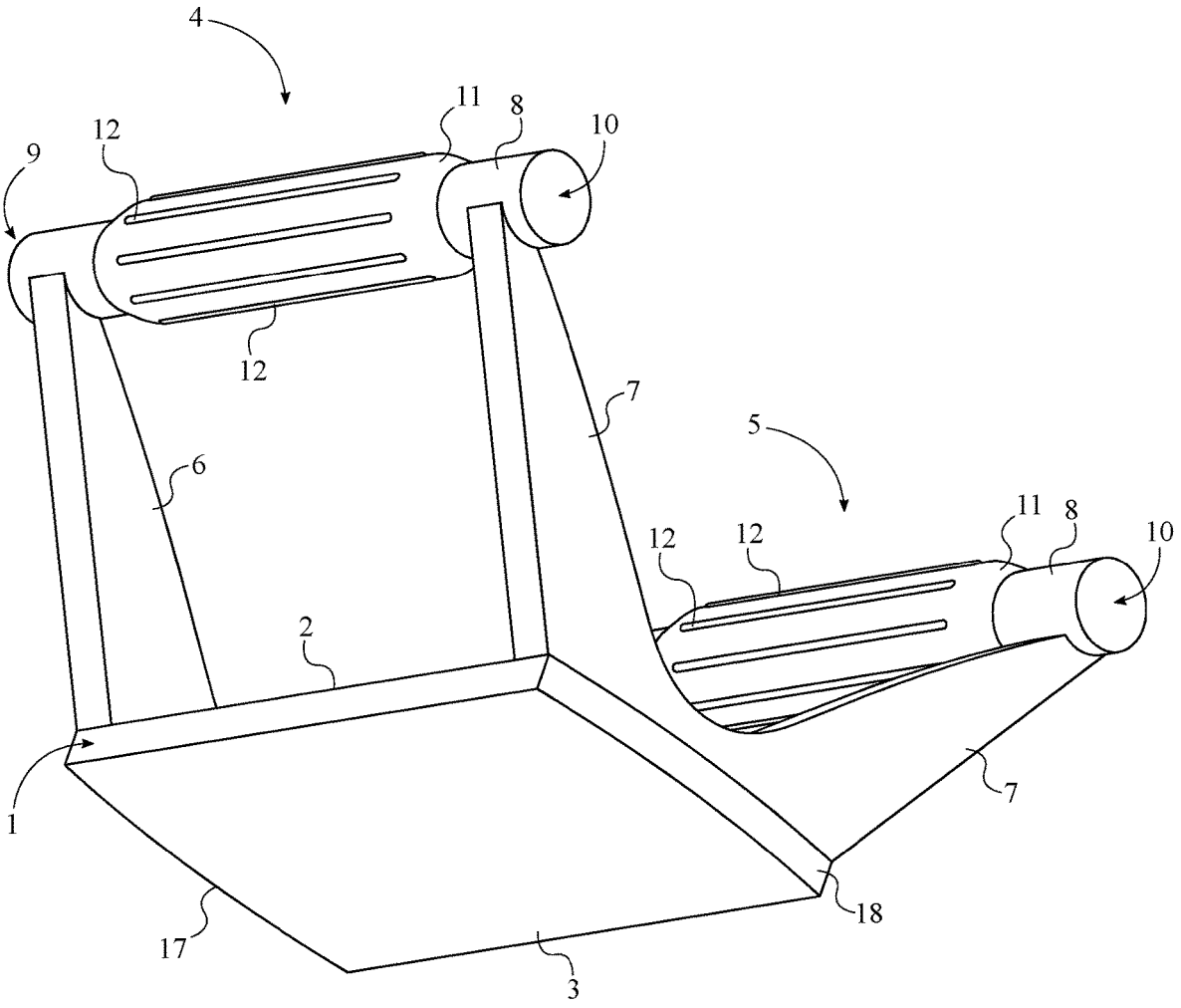
FIG. 3 is a rear-left-bottom perspective view of the present invention.
Figure 4:
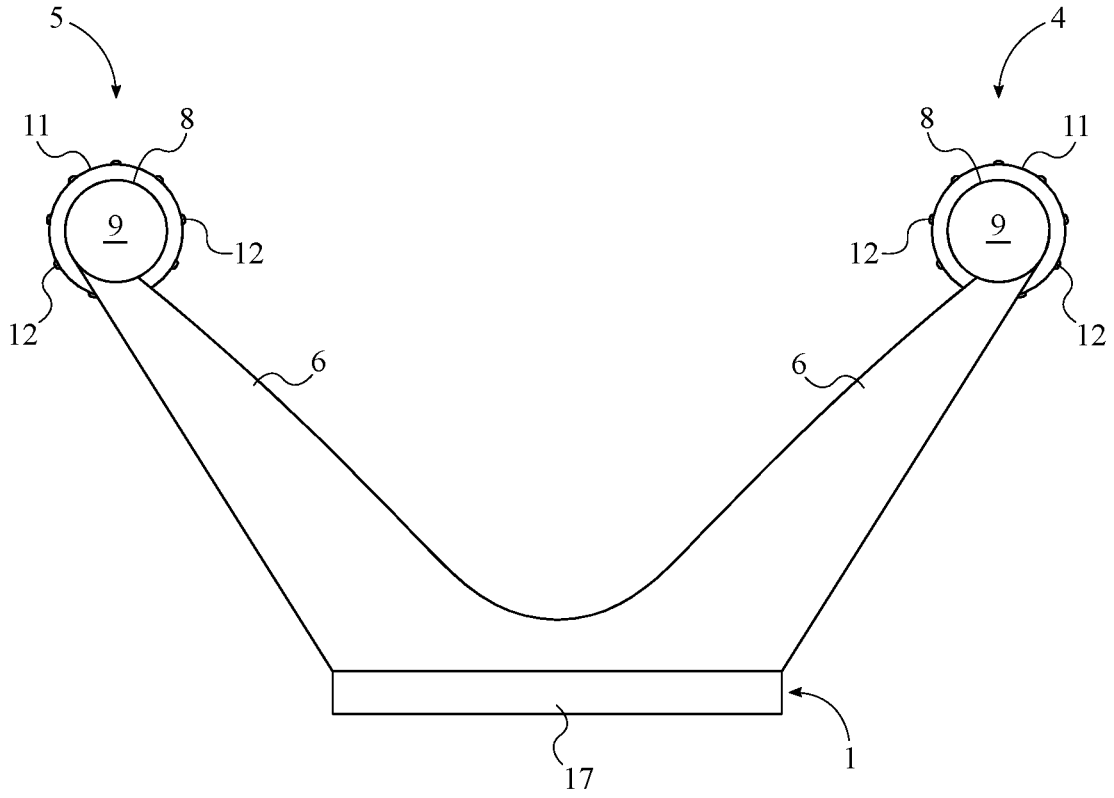
FIG. 4 is a front view of the present invention.
Figure 5:
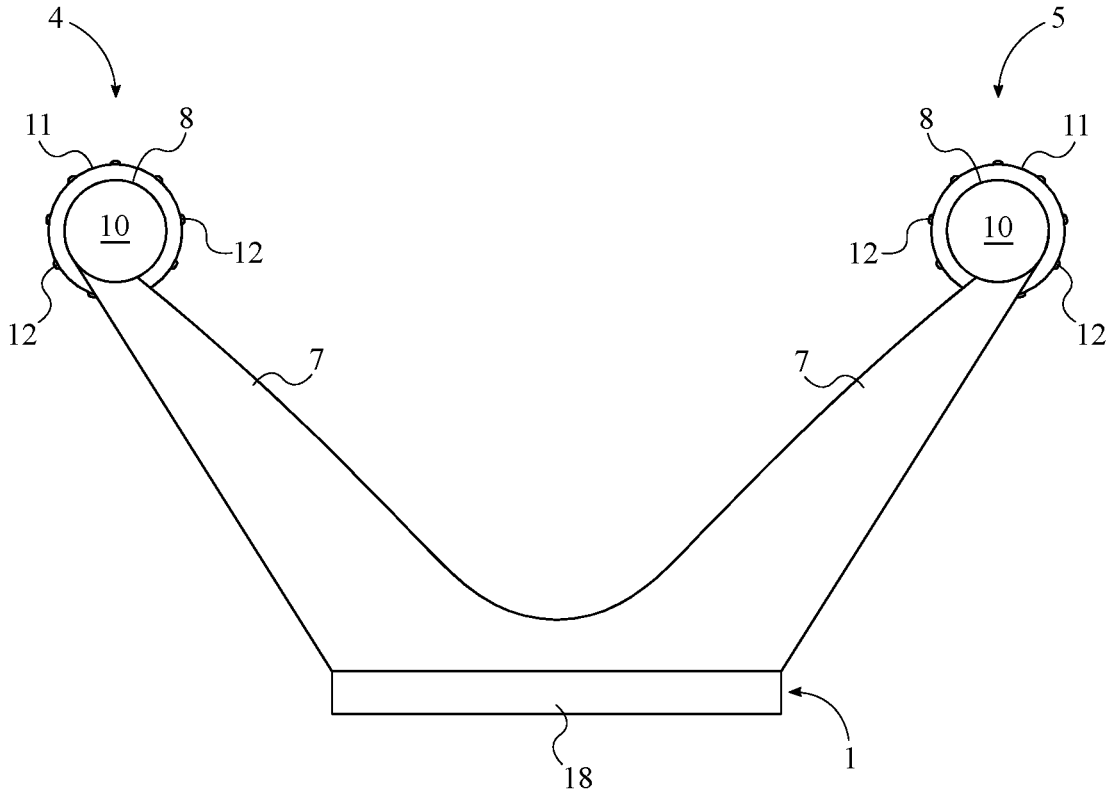
FIG. 5 is a rear view of the present invention.

All illustrations of the drawings are for the purpose of describing selected versions of the present invention and are not intended to limit the scope of the present invention.

The present invention is a multifunctional exercise apparatus, which is used to perform a wide variety of exercises. The present invention allows a user to work different parts of their body with a single apparatus. Thus, the present invention may comprise a base platform 1, a left handle 4, and a right handle 5, which is shown in FIGS. 1 through 9. The base platform 1 is the structural base of the present invention that allows of the other components of the present invention to be arranged and connected together. The left handle 4 allows the user to grasp the present invention with their left, hand, while the tight handle 5 allows the user to grasp the present invention with their right hand. A preferred exercise that can be done with the present invention is for the user to place the base platform 1 against the ground, to position the left handle 4 and the right handle 5 offset from the ground, and to use the present invention as a pushup bar. Another preferred, exercise that can be done with the present invention is for the user to place the left handle 4 and the right handle 5 against the ground, to position the base platform 1 offset from the ground, and to use the present invention as a step platform. Another preferred exercise that can be done with the present invention is for the user to grasp the left handle 4 and/or the right handle 5 and to use the present invention as a kettlebell. As a consequence of the present invention being potentially used as a kettlebell, the base platform 1, the left handle 4, and the right handle 5 are preferably made of a weighted material. In some embodiments, the weighted material is cast iron.

The general configuration of the aforementioned components provides the present invention with a compact design that can be readily deployed to do a variety of exercises. Thus, the base platform 1 comprises a first platform face 2 and a second platform face 3, which are the two large opposing surfaces of the base platform 1. The left handle 4 and the right handle 5 are positioned opposite to each other across the first platform face 2 and are oriented away from each other so that the user can grasp the present invention without their left hand and the right hand being uncomfortably close to each other.

In addition, the left handle 4 and the right handle 5 each comprise a first support member 6, a second support member 7, a bridge member 8, and a handgrip 11. The bridge member 8 is used to support the handgrip 11 offset from the base platform 1 in between the first support member 6 and the second support member 7. The bridge member 8 comprises a first bridge end 9 and a second bridge end 10, which are opposing ends of the bridge member 8. The handgrip 11 provides the left handle 4 and the right handle 5 with sufficient girth for the user to easily grasp the left handle 4 with their left hand and/or the right handle 5 with their right hand. Moreover, the first platform face 2 is terminally connected to the first support member 6 and the second support member 7, which secures the first support member 6 and the second support member 7 to the base platform 1. The first bridge end 9 is terminally connected to the first support member 6, opposite to the first platform face 2, and the second bridge end 10 is terminally connected to the second support member 7, opposite to the first platform face 2. This arrangement allows the bridge member 8 to span between the first support member 6 and the second support member 7. Also, the handgrip 11 is laterally connected around the bridge member 8, which ergonomically shapes the handgrip 11 onto the bridge member 8. The handgrip 11 is centrally positioned along the bridge member 8 so that the user can firmly grasp the handgrip 11 without interference from the first support member 6 and the second support member 7.

Figure 7:
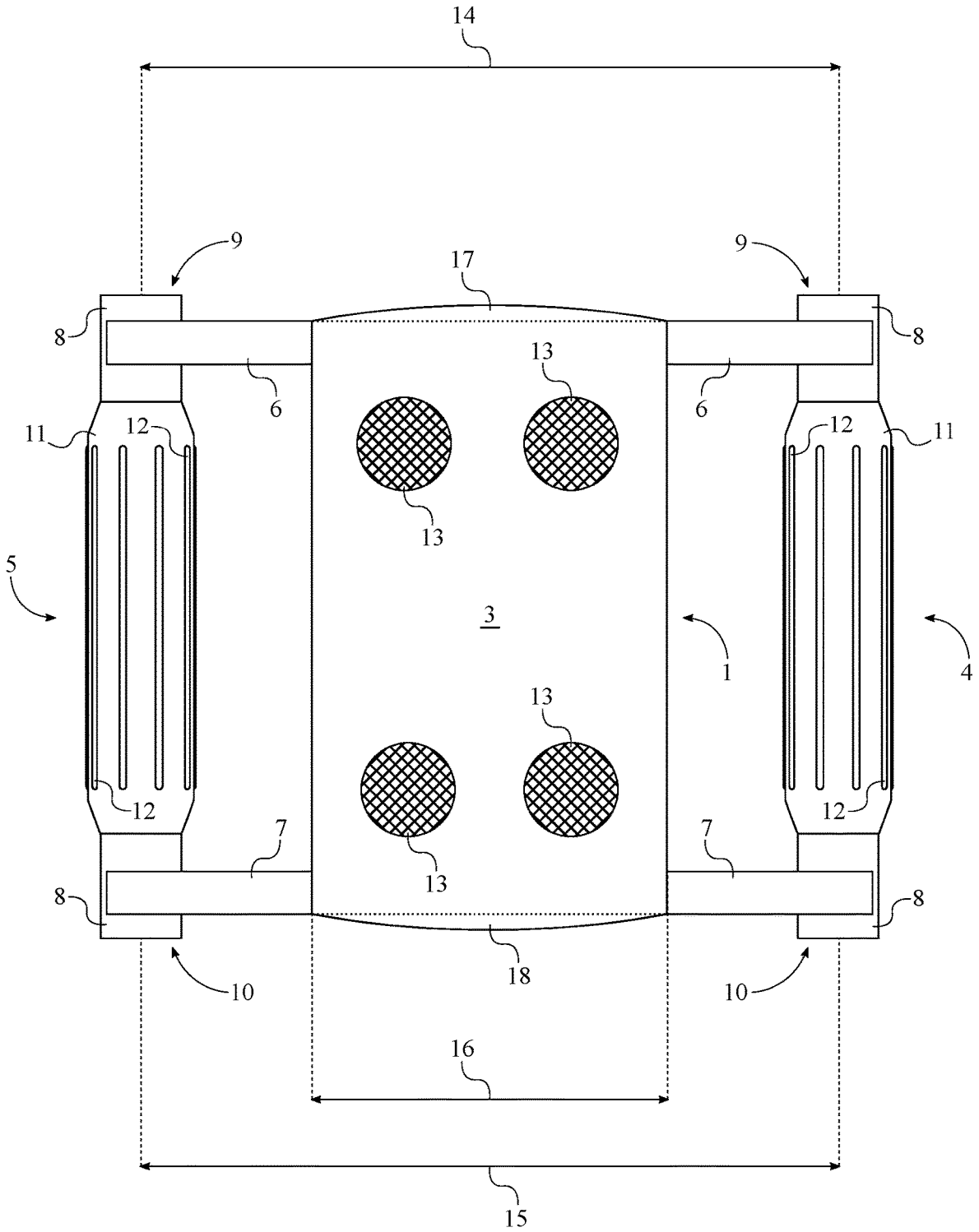
FIG. 7 is a bottom view of the present invention.
Figure 8:
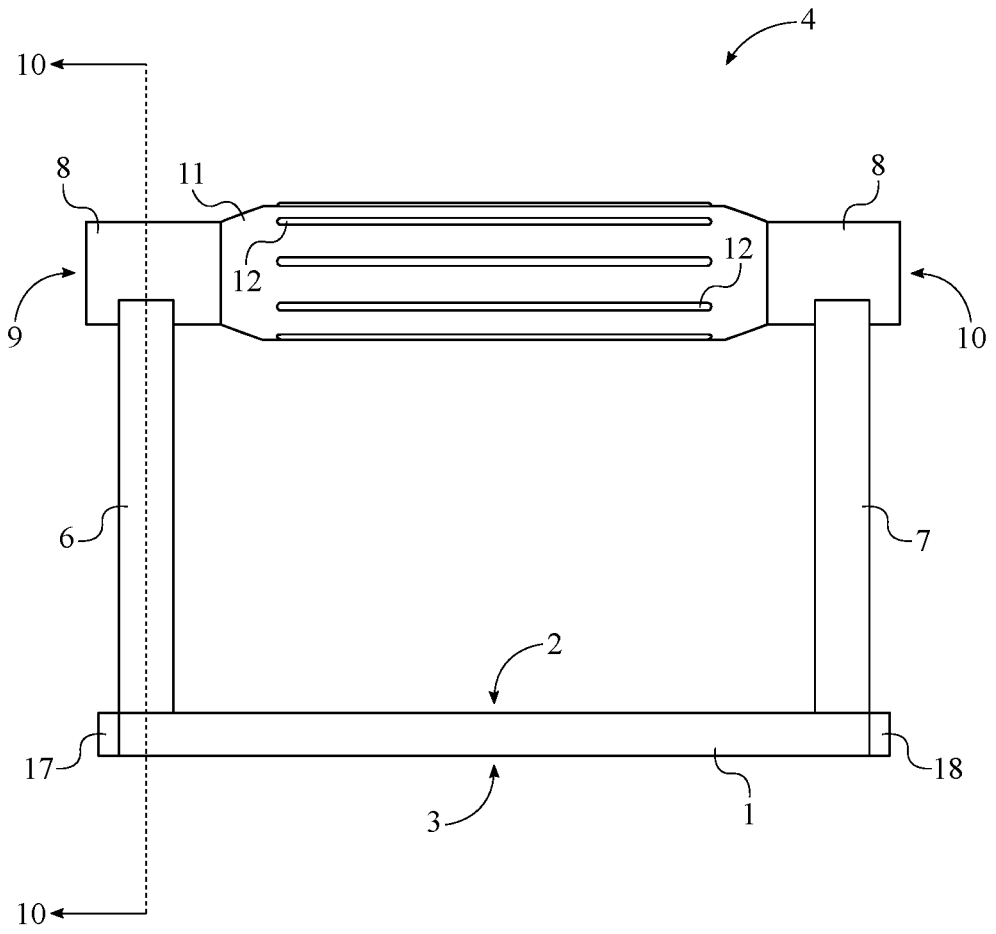
FIG. 8 is a left-side view of the present invention.
Figure 9:
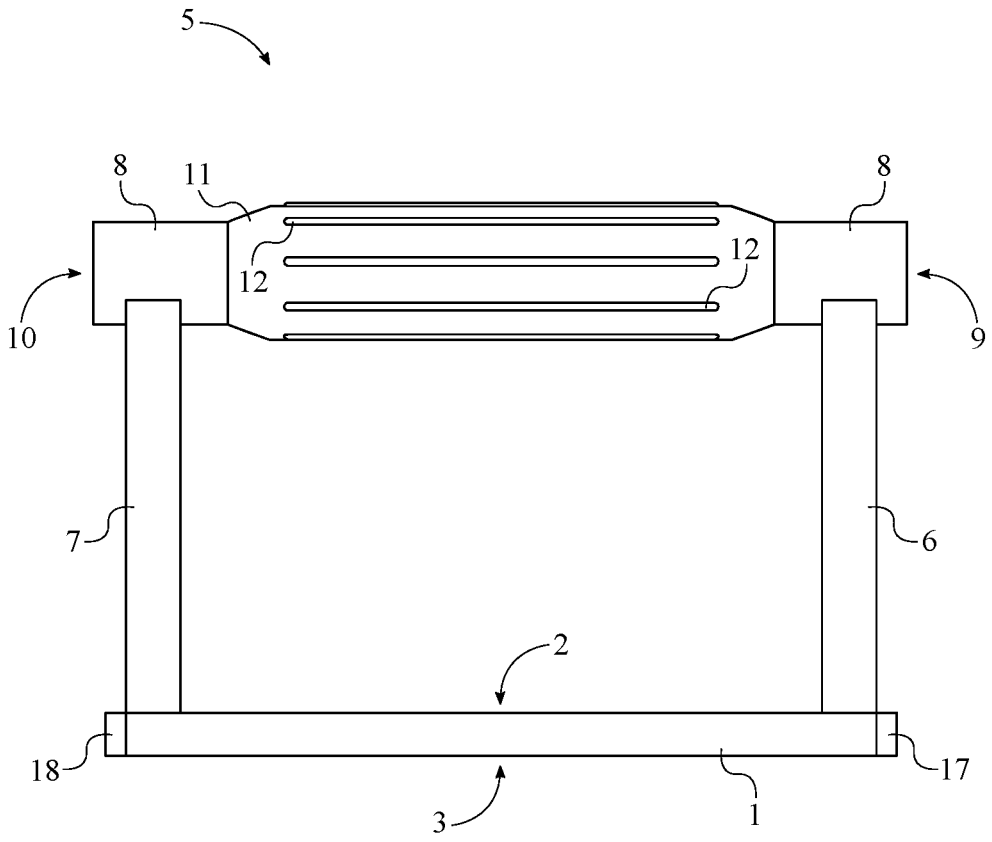
FIG. 9 is a right-side view of the present invention.

As can be seen in FIG. 7, the present invention may further comprise at least one flat grip feature 13, which would be a friction-inducing component with a small thickness. The at least one flat grip feature 13 is mounted onto the second platform face 3 in order to increase the friction felt between the second platform face 3 and the ground as the second platform face 3 laid against the ground. In some embodiments, the at least one flat grip feature 13 is a continuous rubber grip that is positioned across the second platform face 3. In some other embodiments, the at least one flat grip feature 13 is a plurality of discrete rubber grips that are evenly distributed across the second platform face 3.

Figure 6:
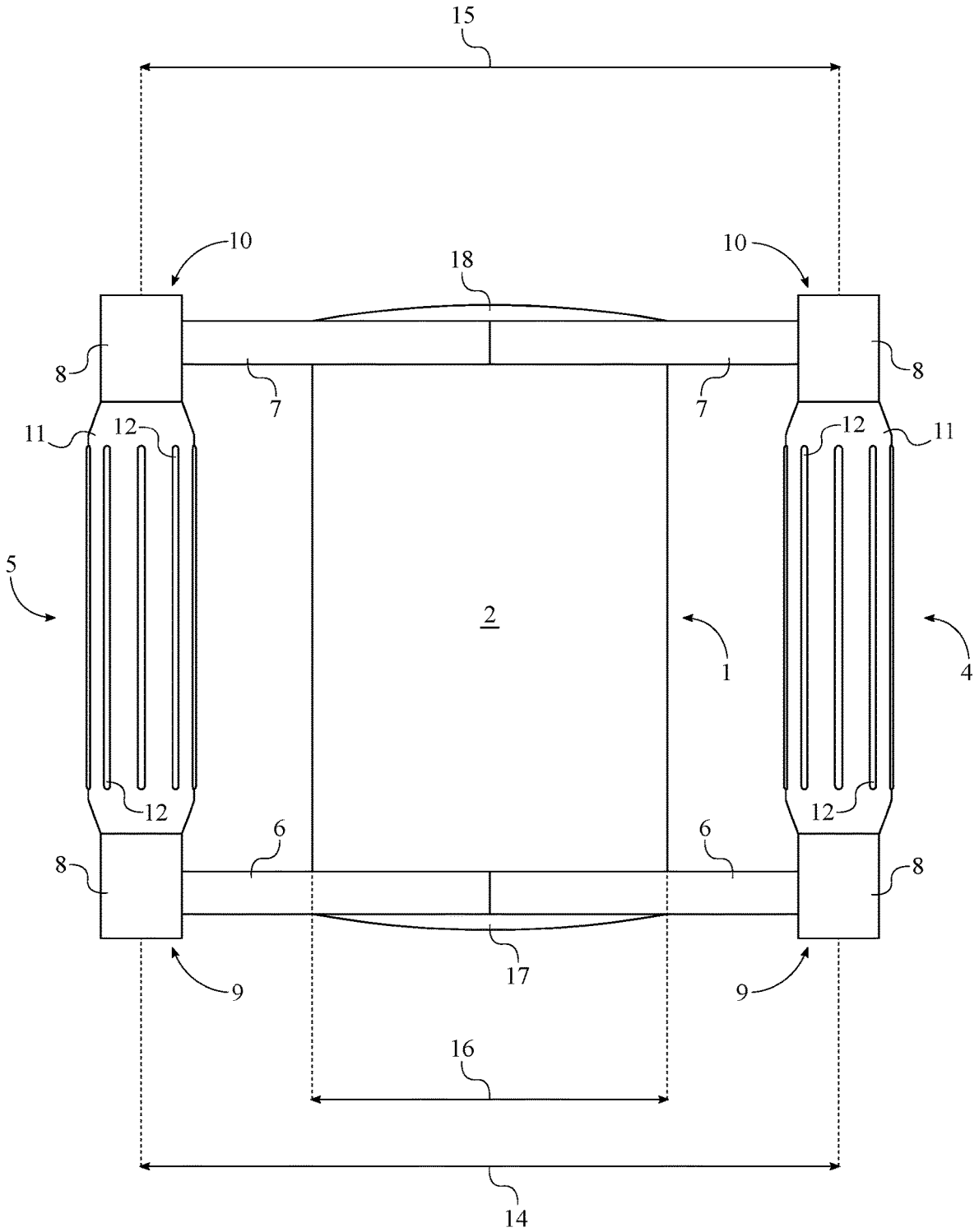
FIG. 6 is a top view of the present invention.

As can be seen in FIGS. 6 and 7, the handgrip 11 of the left handle 4 and the handgrip 11 of the right handle 5 may allow the user's left hand and the user's right hand to grasp the present invention in the same orientation so that the user can more efficiently perform an exercise. Thus, the handgrip 11 of the left handle 4 and the handgrip 11 of the right handle 5 are positioned parallel to each other, which allows the user's left hand and the user's right hand to symmetrically grasp the present invention. The handgrip 11 of the left handle 4 and the handgrip 11 of the right handle 5 is also positioned parallel to the base platform 1 in order to provide a stable feel as the user's left hand and the user's tight hand grasp the present invention.

As can be seen in FIGS. 6 and 7, the handgrip 11 of the left handle 4 and the handgrip 11 of the right handle 5 may be positioned to widen the grasping area of the present invention but narrow the contact area of the present invention with the ground. The tapering of the present invention requires the following definitions: a first offset distance 14 is between the first bridge end 9 of the left handle 4 and the first bridge end 9 of the right handle 5; a second offset distance 15 is between the second bridge end 10 of the left handle 4 and the second bridge end 10 of the right handle 5; and the left handle 4 and the right handle 5 is positioned opposite to each other across a platform width 16 of the base platform 1. Thus, the first offset distance 14 is equal to the second offset distance 15, which allows the bridge member 8 of the left handle 4 and the bridge member 8 of the second handle to maintain their parallel positioning to each other. In addition, the first offset distance 14 and the second offset distance 15 is greater than the platform width 16 so that the tapering of the present invention starts at the handgrip 11 of the left handle 4 and the handgrip 11 of the right handle 5 and ends at the base platform 1.

As can be seen in FIGS. 1 through 9, the left handle 4 and the right handle 5 may each further comprise comprising a plurality of elongated grip features 12, which would preferably be linear ridges integrated into the lateral surface of the handgrip 11. Thus, each of the plurality of elongated grip features 12 is positioned parallel to each the bridge member 8, and the plurality of elongated grip features 12 is evenly distributed around the bridge member 8. This arrangement allows the user's hand to firmly grasp any section of the handgrip 11. Finally, each of the plurality of elongated grip features 12 is laterally connected to the handgrip 11 so that the plurality of elongated grip features 12 can induce more friction between the user's hand and the lateral surface of the handgrip 11.

As can be seen in FIGS. 1 through 9, the present invention may further comprise a first stabilization wing 17 and a second stabilization wing 18, which would be used to better distribute the weight received through the left handle 4 and the right handle 5 against the ground. Thus, the first stabilization wing 17 is peripherally connected the base platform 1, adjacent to the first support member 6 of the left handle 4 and the first support member 6 of the right handle 5, in order to provide one side of the base platform 1 with a larger contact area against the ground. Similarly, the second stabilization wing 18 is peripherally connected the base platform 1, adjacent to the second support member 7 of the left handle 4 and the second support member 7 of the right handle 5, in order to provide another side of the base platform 1 with a larger contact area against the ground.

Figure 10:
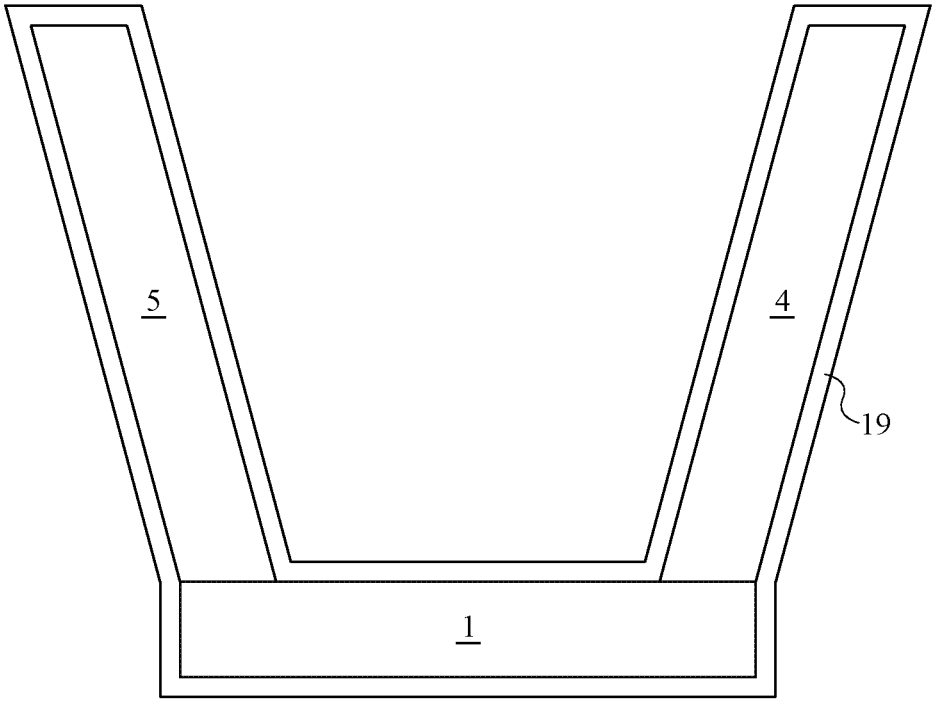
FIG. 10 is a schematic cross-sectional view taken along line 10-10 in FIG. 8.

As can be seen in FIG. 10, the present invention may further comprise a tactile coating 19, which would thermally insulate the components that are preferably made of a thermally conductive material. The tactile coating 19 can be made of, but is not limited to, vinyl or rubber. Thus, the base platform 1, the left handle 4, and the right handle 5 are enclosed by the tactile coating 19, which consequently prevents a cold-to-the-touch feeling as the user grasps the base platform 1, the left handle 4, the right handle 5, or a combination thereof. This arrangement also allows any jagged features or any shape edges located on the base platform 1, the left handle 4, the right handle 5, or a combination thereof to be covered up by the tactile coating 19.

SUPPLEMENTAL DESCRIPTION

In reference to FIGS. 1 through 9, the present invention is a piece of exercise equipment which can be used to perform a wide variety of exercises. The present invention comprises a base member, a first side wall, a second side wall, a first handle, and a second handle. It is an aim of the present invention to provide a versatile exercise device which can be used in different ways to work on different body parts of users. It is another aim of the present invention to reduce the number of pieces of exercise equipment to save storage space.

The base member is a generally planar base member with a top surface and a bottom surface. In the illustrated embodiment, the base member has a substantially rectangular shape. However, it should be noted that the base member may also take many other shapes, including but not limited to a quadrilateral, a circle, or any other suitable regular or irregular shapes. Preferably, two short sides of the base member, i.e., a first short side and a second short side, are curved sides. When used as a push-up bar, the base member engages the floor. The base member may be made from heavy weighted material (e.g., cast-iron), and the size of the base member (especially the thickness) can vary to provide different weights.

The first side wall and the second side wall are configured to support the first handle and the second handle. In a preferred embodiment, both the first side wall and the second side wall extend upright from the top surface of the base member and are substantially parallel to each other.

Preferably, the first side wall and the second side wall are arranged adjacent to the first short side and the second short side of the base member, respectively. In the preferred embodiment, each of the first side wall and the second side wall comprises a first supporting arm and a second supporting arm. Each supporting arm is inclined to form a predetermined angle to the base member. For instance, the angle formed between the supporting arm and the planar base member may range from 30° to 90°, and preferably from 45° to 75°. The angle and length of each arm are selected to provide appropriate heights of the handles and a suitable distance between the handles. Although each side wall is shown as comprising two supporting arms, each side wall does not necessarily comprise the supporting arms. For example, the side wall may be shaped to be a trapezoid.

The first handle extends from the first supporting arm of the first side wall to the first supporting arm of the second side wall; similarly, the second handle extends from the second supporting arm of the first side wall to the second supporting arm of the second side wall. Preferably, the ends of each handle extend slightly beyond the side walls. Each handle is securely fixed to the supporting arms by any suitable technology, including but not limited to welding. Each handle may comprise a handgrip portion at the center of the handle. Preferably, each handle has a circular cross-section. However, other cross-sectional shapes (such as an oval shape, etc.) are also possible. In the illustrated embodiment, the handgrip portion has a slightly greater diameter than the rest of the handle; however, it should be understood that the diameter of handgrip portion may be the same as the rest of the handle. In one embodiment, the handgrip portion may be formed integrally with the handle. In another embodiment, the handgrip portion may also be a separate member which can be attached to and/or removed from the handle. The handgrip portion may be made of and/or may have a non-slip frictional surface to prevent slippage of hand grips while the user is performing a push-up exercise. In a preferred embodiment, each handgrip portion comprises a plurality of elongated ridges running along the length of the handle for anti-slippery purpose.

In one embodiment, all the components of the apparatus may be made from heavy weighted material (for example, cast-iron). However, the components of the apparatus may also be made from different material. For example, the base member and the supporting arms may be made from cast-iron, and the handle may be made from rigid plastic. The heavy weighted material allows the apparatus to act as a kettlebell exercise device. Therefore, the present invention can be used to perform swings, squats, arm raises, bicep curls, etc. In a preferred embodiment, the apparatus further comprises a plastic coating (e.g., vinyl coating) or rubber cover, to provide a durable and aesthetic outer surface.

As mentioned above, when the bottom surface of the base member engages the floor, the present invention can be used as a regular push-up bar. Moreover, the present invention can also be flipped over such that the first handle and the second handle engage the floor. In this configuration, the present invention can act as a step platform to facilitate leg workouts of the users.

Although the invention has been explained in relation to its preferred embodiment, it is to be understood that many other possible modifications and variations can be made without departing from the spirit and scope of the invention as hereinafter claimed.

What is claimed is:

1. A multifunctional exercise apparatus comprising:

a base platform;

a left handle;

a right handle;

a tactile coating;

the base platform comprising a first platform face and a second platform face;

the left handle and the right handle each comprising a first support member, a second support member, a bridge member, a handgrip, and a plurality of elongated grip features;

the bridge member comprising a first bridge end and a second bridge end;

the left handle and the right handle being positioned opposite to each other across the first platform face;

the left handle and the right handle being oriented away from each other;

the base platform being a rectangular prism;

the first platform face being terminally connected to the first support member and the second support member;

the first bridge end being terminally connected to the first support member, opposite the first platform face;

the second bridge end being terminally connected to the second support member, opposite the first platform face;

the handgrip being laterally connected around the bridge member;

the handgrip being centrally positioned along the bridge member;

the handgrip being a rigid annular protrusion off of the bridge member;

a length of the handgrip being less than a length of the bridge member;

a girth of the handgrip being greater than a girth of the bridge member;

each of the plurality of elongated grip features being positioned parallel to the bridge member;

the plurality of elongated grip features being evenly distributed around the bridge member;

each of the plurality of elongated grip features being laterally connected to the handgrip; and the base platform, the left handle, and the right handle being enclosed by the tactile coating; and wherein in a top view of the multifunctional exercise apparatus, an entirety of the rectangular prism is oriented between the left handle and the right handle.

2. The multifunctional exercise apparatus as claimed in claim 1 further comprising:

at least one flat grip feature;

the at one least flat grip feature being mounted onto the second platform face; and the at least one flat grip feature being made of rubber.

3. The multifunctional exercise apparatus as claimed in claim 1 further comprising:

the handgrip of the left handle and the handgrip of the right handle being positioned parallel to each other; and the handgrip of the left handle and the handgrip of the right handle being positioned parallel to the base platform.

4. The multifunctional exercise apparatus as claimed in claim 1 further comprising:

a first offset distance being between the first bridge end of the left handle and the first bridge end of the right handle;

a second offset distance being between the second bridge end of the left handle and the second bridge end of the right handle;

the left handle and the right handle being positioned opposite to each other across a platform width of the base platform;

the first offset distance and the second offset distance being equal to each other; and the first offset distance and the second offset distance being greater than the platform width.

5. The multifunctional exercise apparatus as claimed in claim 1 further comprising:

a first stabilization wing;

a second stabilization wing;

the first stabilization wing being peripherally connected to the base platform, adjacent to the first support member of the left handle and the first support member of the right handle;

the second stabilization wing being peripherally connected to the base platform, adjacent to the second support member of the left handle and the second support member of the right handle; and a width of the first stabilizing wing and a width of the second stabilizing wing being coextensive to a platform width of the base platform.

6. The multifunctional exercise apparatus as claimed in claim 1, wherein the base platform, the left handle, and the right handle are made of a weighted material.

7. The multifunctional exercise apparatus as claimed in claim 6, wherein the weighted material is cast iron.

8. The multifunctional exercise apparatus as claimed in claim 1, wherein the tactile coating is made of a material selected from a group consisting of: vinyl and rubber.

9. A multifunctional exercise apparatus comprising:

a base platform;

a left handle;

a right handle;

a tactile coating;

the base platform comprising a first platform face and a second platform face;

the left handle and the right handle each comprising a first support member, a second support member, a bridge member, a handgrip, and a plurality of elongated grip features;

the bridge member comprising a first bridge end and a second bridge end;

the left handle and the right handle being positioned opposite to each other across the first platform face;

the left handle and the right handle being oriented away from each other;

the base platform being a rectangular prism;

the first platform face being terminally connected to the first support member and the second support member;

the first bridge end being terminally connected to the first support member, opposite the first platform face;

the second bridge end being terminally connected to the second support member, opposite the first platform face;

the handgrip being laterally connected around the bridge member;

the handgrip being centrally positioned along the bridge member;

the handgrip being a rigid annular protrusion off of the bridge member;

a length of the handgrip being less than a length of the bridge member;

a girth of the handgrip being greater than a girth of the bridge member;

a first offset distance being between the first bridge end of the left handle and the first bridge end of the right handle;

a second offset distance being between the second bridge end of the left handle and the second bridge end of the right handle;

the left handle and the right handle being positioned opposite to each other across a platform width of the base platform;

the first offset distance and the second offset distance being equal to each other; and the first offset distance and the second offset distance being greater than the platform width;

wherein in a top view of the multifunctional exercise apparatus, an entirety of the rectangular prism is oriented between the left and right handles;

each of the plurality of elongated grip features being positioned parallel to the bridge member;

the plurality of elongated grip features being evenly distributed around the bridge member;

each of the plurality of elongated grip features being laterally connected to the handgrip; and the base platform, the left handle, and the right handle being enclosed by the tactile coating.

10. The multifunctional exercise apparatus as claimed in claim 9 further comprising:

at least one flat grip feature;

the at one least flat grip feature being mounted onto the second platform face; and the at least one flat grip feature being made of rubber.

11. The multifunctional exercise apparatus as claimed in claim 9 further comprising:

the handgrip of the left handle and the handgrip of the right handle being positioned parallel to each other; and the handgrip of the left handle and the handgrip of the right handle being positioned parallel to the base platform.

12. The multifunctional exercise apparatus as claimed in claim 9 further comprising:

a first stabilization wing;

a second stabilization wing;

the first stabilization wing being peripherally connected to the base platform, adjacent to the first support member of the left handle and the first support member of the right handle;

the second stabilization wing being peripherally connected to the base platform, adjacent to the second support member of the left handle and the second support member of the right handle; and a width of the first stabilizing wing and a width of the second stabilizing wing being coextensive to the platform width.

13. The multifunctional exercise apparatus as claimed in claim 9, wherein the base platform, the left handle, and the right handle are made of a weighted material, and wherein the weighted material is cast iron.

14. The multifunctional exercise apparatus as claimed in claim 9, wherein the tactile coating is made of a material selected from a group consisting of: vinyl and rubber.

15. A multifunctional exercise apparatus comprising:

a base platform;

a left handle;

a right handle;

a tactile coating;

the base platform comprising a first platform face and a second platform face;

the left handle and the right handle each comprising a first support member, a second support member, a bridge member, a handgrip, and a plurality of elongated grip features;

the bridge member comprising a first bridge end and a second bridge end;

the left handle and the right handle being positioned opposite to each other across the first platform face;

the left handle and the right handle being oriented away from each other;

the base platform being a rectangular prism;

the first platform face being terminally connected to the first support member and the second support member;

the first bridge end being terminally connected to the first support member, opposite the first platform face;

the second bridge end being terminally connected to the second support member, opposite the first platform face;

the handgrip being laterally connected around the bridge member;

the handgrip being centrally positioned along the bridge member;

the handgrip being a rigid annular protrusion off of the bridge member;

a length of the handgrip being less than a length of the bridge member;

a girth of the handgrip being greater than a girth of the bridge member;

a first offset distance being between the first bridge end of the left handle and the first bridge end of the right handle;

a second offset distance being between the second bridge end of the left handle and the second bridge end of the right handle;

the left handle and the right handle being positioned opposite to each other across a platform width of the base platform;

the first offset distance and the second offset distance being equal to each other;

the first offset distance and the second offset distance being greater than the platform width;

wherein in a top view of the multifunctional exercise apparatus, an entirety of the rectangular prism is oriented between the left and right handles;

the handgrip of the left handle and the handgrip of the right handle being positioned parallel to each other;

the handgrip of the left handle and the handgrip of the right handle being positioned parallel to the base platform;

each of the plurality of elongated grip features being positioned parallel to the bridge member;

the plurality of elongated grip features being evenly distributed around the bridge member;

each of the plurality of elongated grip features being laterally connected to the handgrip; and the base platform, the left handle, and the right handle being enclosed by the tactile coating.

16. The multifunctional exercise apparatus as claimed in claim 15 further comprising:

at least one flat grip feature;

the at one least flat grip feature being mounted onto the second platform face; and the at least one flat grip feature being made of rubber.

17. The multifunctional exercise apparatus as claimed in claim 15 further comprising:

a first stabilization wing;

a second stabilization wing;

the first stabilization wing being peripherally connected to the base platform, adjacent to the first support member of the left handle and the first support member of the right handle;

the second stabilization wing being peripherally connected to the base platform, adjacent to the second support member of the left handle and the second support member of the right handle; and a width of the first stabilizing wing and a width of the second stabilizing wing being coextensive to the platform width.

18. The multifunctional exercise apparatus as claimed in claim 15 further comprising:

the base platform, the left handle, and the right handle being made of a weighted material;

the weighted material being cast iron; and the tactile coating being made of a material selected from a group consisting of: vinyl and rubber.

* * * * *